US005829682A

United States Patent [19]

Haruch

[11] Patent Number: 5,829,682

[45] Date of Patent: Nov. 3, 1998

[54] AIR-ASSISTED SPRAY NOZZLE ASSEMBLY

[75] Inventor: James Haruch, Naperville, Ill.

[73] Assignee: Spraying Systems Co., Wheaton, Ill.

[21] Appl. No.: 638,277

[22] Filed: Apr. 26, 1996

[51] Int. Cl.[6] ..... B05B 7/08

[52] U.S. Cl. ..... 239/419; 239/431; 239/544

[58] Field of Search ..... 239/543, 430, 239/427, 431, 329, 419, 429, 544

[56] References Cited

U.S. PATENT DOCUMENTS

| | | | |
|---|---|---|---|
| 1,230,982 | 6/1917 | Barber | 239/543 |
| 1,934,397 | 11/1933 | Rudolph | 239/431 X |
| 1,999,121 | 4/1935 | Wilson | 239/430 |
| 3,567,116 | 3/1971 | Lindlof | 239/431 X |
| 3,829,013 | 8/1974 | Ratnik | 239/431 X |
| 4,625,916 | 12/1986 | Nieuwkamp et al. | 239/431 |
| 5,088,649 | 2/1992 | Hanson et al. | 239/329 |

*Primary Examiner*—Kevin Weldon
*Attorney, Agent, or Firm*—Leydig, Voit & Mayer, Ltd.

[57] ABSTRACT

An air-assisted spray nozzle assembly including a pre-atomizing section and a spray tip located downstream of said pre-atomizing section. The spray tip has an upstream chamber for receiving pre-atomized liquid from the pre-atomizing section, a downstream chamber separated from the upstream chamber by an end wall, and the end wall is formed with a plurality of discharge passages adjacent its outer perimeter for directing a plurality of discharging flow streams in part in an outward axial direction and in part in a direction toward each other for defining a well defined conical or flat spray pattern.

26 Claims, 2 Drawing Sheets

AIR-ASSISTED SPRAY NOZZLE ASSEMBLY

FIELD OF THE INVENTION

The present invention relates generally to spray nozzle assemblies, and more particularly, to pressurized air atomizing spray nozzle assemblies.

BACKGROUND OF THE INVENTION

In many spray applications, it is desirable to generate relatively fine spray particles so as to maximize surface area. For this purpose, it is known to pre-atomize the liquid flow stream with pressurized air prior to discharge through a nozzle. tip. In known spray assemblies, liquid particle breakdown occurs primarily during the pressurized air pre-atomization and the spray tip serves to form the discharging spray pattern. A problem with such spray nozzle systems is that in order to increase liquid atomization and particle breakdown, higher air pressures are required. Higher air pressures, on the other hand, tend to narrow the discharging spray pattern, making it difficult to generate and control well defined spray patterns. Spray tips proposed for forming specific discharging spray patterns, further more, often have been relatively complex in design, and hence, relatively expensive to produce.

SUMMARY OF THE INVENTION

It is an object of the present invention to provide a spray nozzle assembly in which pressurized air pre-atomized liquid may be directed with more well defined discharge spray patterns.

Another object is to provide a spray nozzle assembly as characterized above which is adapted for spraying narrow angle round and flat spray patterns.

A further object is to provide a spray nozzle assembly of the above kind having a uniquely designed spray tip which is effective for directing pre-atomized liquid particles in well defined spray patterns, while also augmenting liquid particle breakdown for fine particle spraying.

Yet another object is to provide a spray nozzle assembly of the foregoing type that is adapted for more efficiently atomizing and directing fine liquid particle spray patterns.

Another object is to provide a spray tip for use in such nozzle assembly that is relatively simple in design and which lends itself to economical manufacture.

These and other objects and advantages of the invention will become more apparent from the following detailed description when taken in conjunction with the accompanying drawings.

Figure 1:
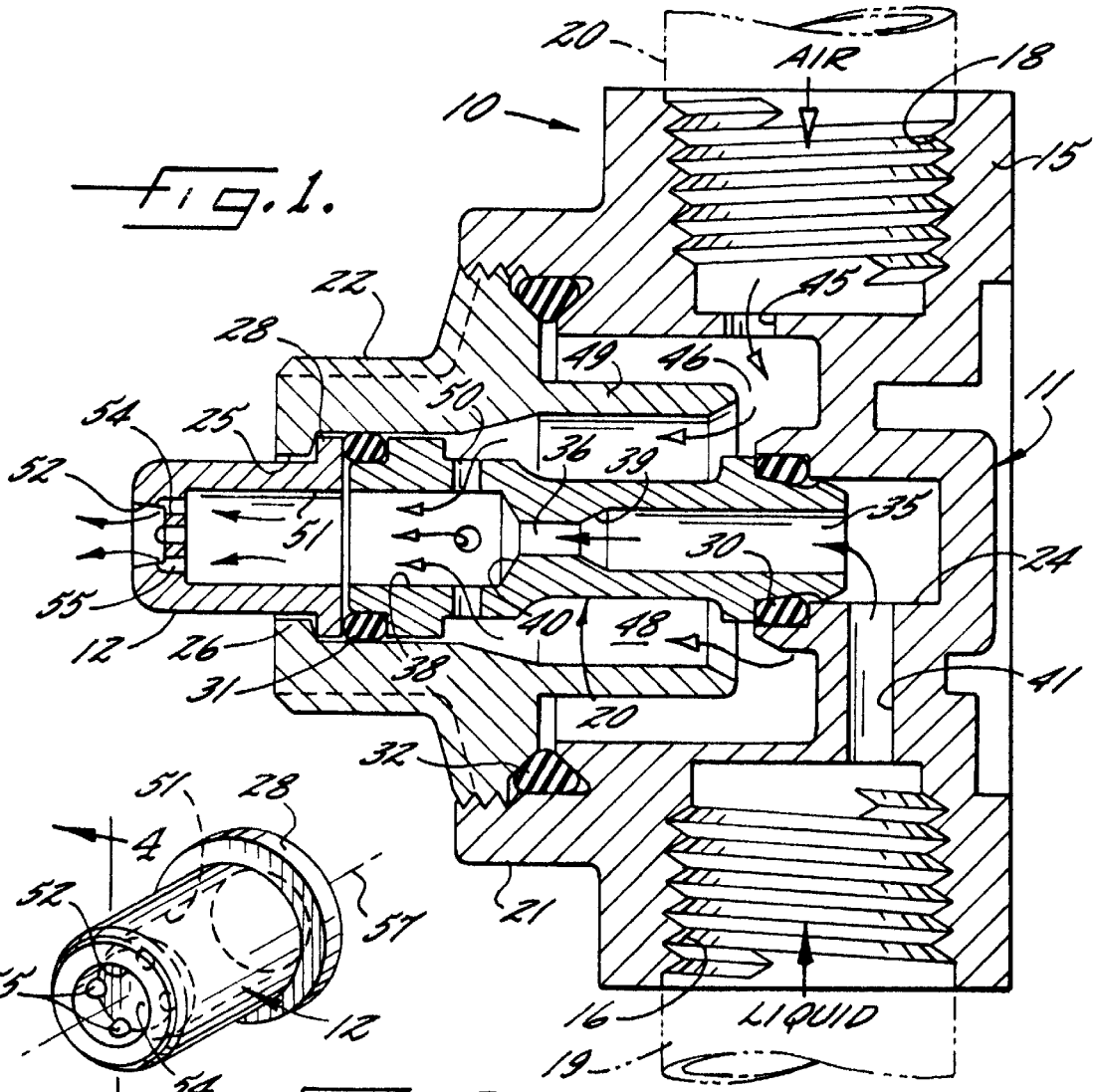
FIG. 1 is a section view taken axially through a spray nozzle assembly embodying the present invention.
Figure 2:
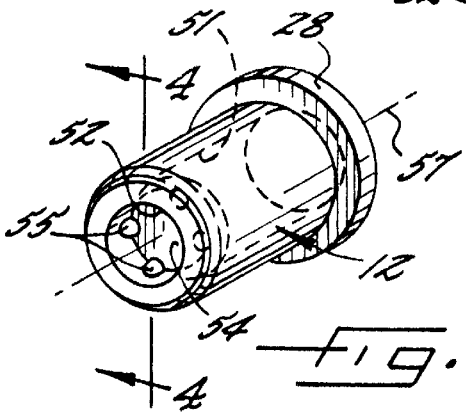
FIG. 2 is an enlarged perspective of the spray tip of the nozzle assembly shown in FIG. 1.
Figure 3:
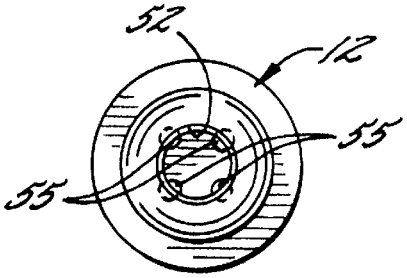
FIG. 3 is an end view of the spray tip shown in FIG. 2.

While the invention is susceptible of various modifications and alternative constructions, certain illustrated embodiments thereof have been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENTS

Referring now more particularly to the drawings, there is shown an illustrative spray nozzle assembly 10 embodying the present invention. The spray nozzle assembly 10 basically comprises a pre-atomizing section 11 for receiving respective pressurized liquid and gas flow streams for pre-atomizing liquid and a spray tip 12 mounted downstream of the pre-atomizing section 11 for further breaking down the pre-atomized liquid spray particles and for directing such particles in a predetermined defined spray pattern. The pre-atomizing section may be of a type disclosed in U.S. patent application Ser. No. 08/349,402, assigned to the same assignee as the present application, the disclosure of which is incorporated by reference. It will be understood that other means for pre-atomizing the liquid flow stream may be employed.

The illustrated spray nozzle assembly 10 includes a main body 15 formed with threaded liquid and gas inlet ports 16, 18, respectively. Lines 19 and 20 are connected to the respective ports 16 and 18 and supply the body 15 with pressurized streams of liquid and gas. The gas stream typically is pressurized air.

To facilitate pre-atomization of liquid introduced into the nozzle body 15 from the liquid inlet port 16, the pre-atomizing section 11 includes an elongated, generally cylindrical atomizing member 20 disposed within the body 15 intermediate the liquid and gas ports 16, 18 with the longitudinal axis of the illustrated atomizing member 20 being in perpendicular relation to an axis through the ports 16, 18. For supporting the pre-atomizing member 20 within the main body 15, the body 15 has a forwardly extending, internally threaded cylindrical extension 21 into which an externally threaded retainer cap 22 is engaged. The pre-atomizing member 20 has an upstream end supported within a cylindrical chamber 24 of the main body 15 and a downstream end supported within an annular opening 25 in the end of the retainer cap 22. The annular opening 25 of the retainer cap 22 is defined by inwardly extending annular lip 26 which engages an outwardly extending annular flange 28 of the spray tip 12 for retaining both the spray tip 12, and atomizing member 20 in mounted position. An O-ring 30 is interposed between an upstream end of the atomizing member 20 and the main body 15, an O-ring 31 is compressed between a downstream end of the atomizing member 20 and the retaining cap 22 and spray tip flange 28, and an O-ring 32 is interposed between the retainer cap 22 and the forward extension 21 of the main body.

The atomizing member 20 is formed with a central inlet flow passage 35, which communicates with a flow restricting orifice 36, and which in turn communicates with a cylindrical expansion chamber 38 of larger diameter than the flow passageway 35. The flow restricting orifice 36 in this case includes frusto conical upstream and downstream portions 39, 40, respectively. Liquid introduced into the port 16 communicates through a body passage 41 and the chamber 24 with the inlet flow passage 35 of the atomizing member 20. Pressurized air introduced into the air inlet port 18 communicates through a passage 45 and chamber 46 in the main body 15 with an annular chamber 48 defined between an outer periphery of a central portion of the atomizing member 20 and a cylindrical wall 49 of an upstream extension of the retainer cap. Pressurized air in the annular chamber 48 is directed into the expansion chamber 38*d* of the atomizing member 20 through a plurality of radial passages 50. It will be seen, therefore, that pressurized liquid introduced through the liquid port 16 is accelerated through the restricting orifice 36 into the expansion chamber 38 where it is broken up and pre-atomized by a multiplicity of pressurized air streams directed through the radial passages 50. The pre-atomized liquid flow stream is thereupon directed through the spray tip 12 and the atmosphere as a discharging spray pattern.

It will be understood by one skilled in the art that by using higher pressurized air streams, greater pre-atomization and liquid particle break down may be achieved. The present invention contemplates utilizing relatively high air pressure flow streams, such as up to about 100 psi, for achieving relatively fine liquid particle break down. Heretofore, spraying systems using high pre-atomizing air pressures have created relatively narrow and difficult to control discharging spray patterns.

In accordance with the invention, the spray tip is adapted for enhancing further breakdown of the pre-atomized liquid particles and for directing the discharging particles into a well defined spray pattern. To this end, the spray tip 12 has an inlet chamber 51 with an upstream open end for receiving pre-atomized liquid exiting the atomizing member 20 and a downstream chamber 52 communicating with the atmosphere and separated from the upstream chamber 51 by an end wall 54. The end wall 54 is formed with a plurality of discharge passages 55 which communicate with the downstream chamber 52 in a manner that directs the plurality of discharging flow streams in part in a downstream direction and at least in part in a direction toward each other.

The inlet chamber 51 of the illustrated spray tip 12 has an elongated cylindrical configuration of a diameter substantially the same as the expansion chamber 38 of the atomizing member 20. The end wall 54 has a substantially flat upstream face which is perpendicular to the axis 57 of the spray tip 12, and the discharge passages 55, which in this case are four in number, are disposed at circumferentially spaced locations near the outer periphery of the end wall 54. The spray tip downstream chamber 52 in this instance is defined by a substantially flat downstream face of the end wall 54, which also is perpendicular to the axis of the spray tip, and a frusto conical side wall 59 which tapers outwardly in the downstream direction at an angle of about 10° to the spray tip axis. Alternatively, the downstream chamber may have a cylindrical side wall, or in other words, a side wall that does not taper with respect to the spray tip axis.

Figure 4:
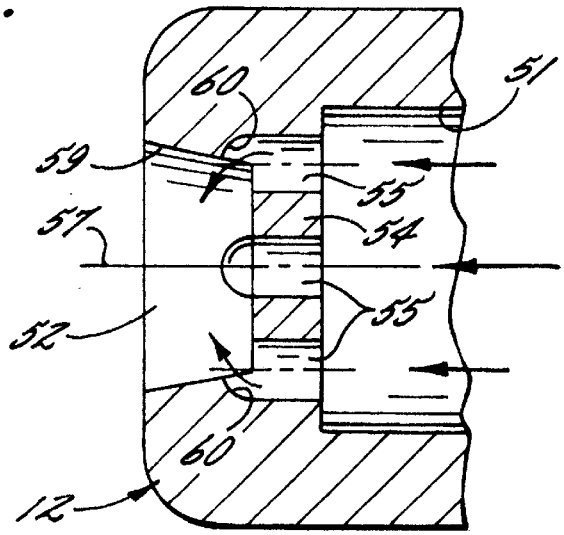
FIG. 4 is an enlarged fragmentary section of the spray tip shown in FIG. 2, taken in the plane of line 4—4.
Figure 5:
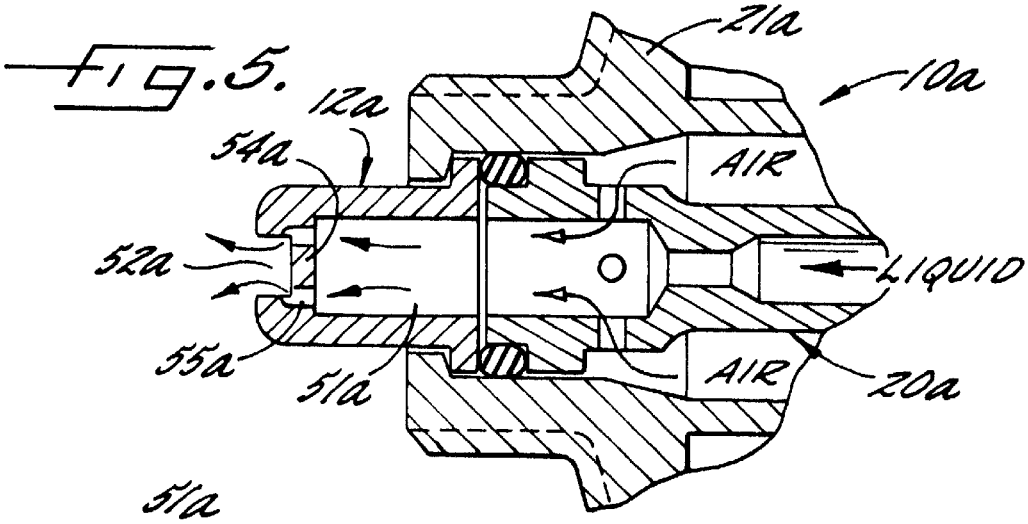
FIG. 5 is a fragmentary section of an alternative embodiment of the spray nozzle assembly according to the present invention.
Figure 6:
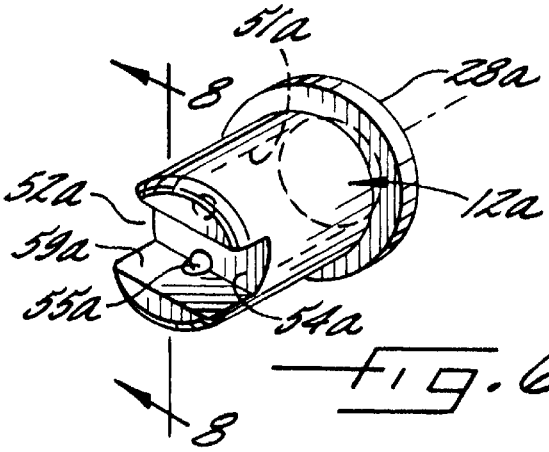
FIG. 6 is an enlarged perspective of the spray tip of the nozzle assembly shown in FIG. 5.
Figure 7:
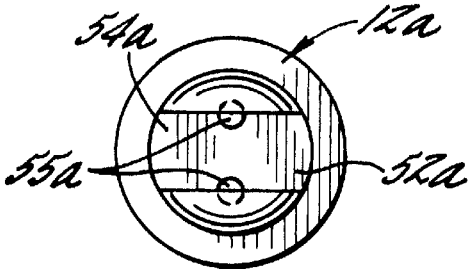
FIG. 7 is an end view of the spray tip shown in FIG. 6.
Figure 8:
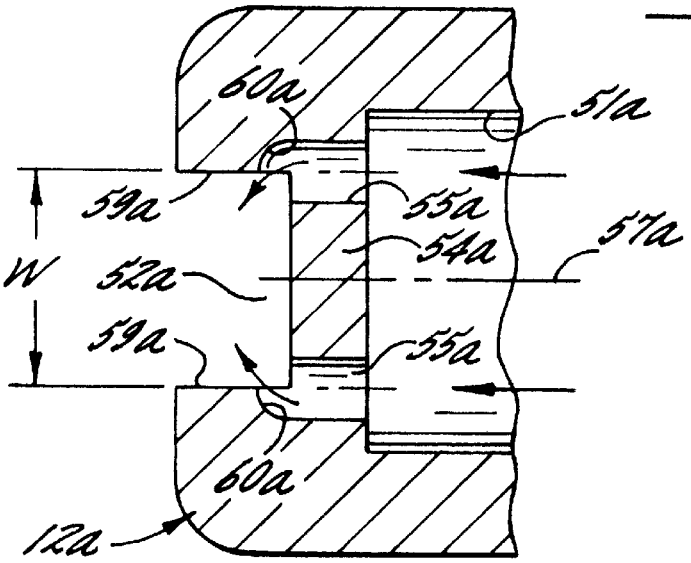
FIG. 8 is an enlarged fragmentary section of the spray tip shown in FIG. 6, taken in the plane of line 8—8.

In keeping with the invention, the discharge passages at least in part communicate with and extend through a side wall of the downstream spray tip chamber for directing the plurality of flow streams into the chamber and at least in part inwardly toward each other. In the illustrated embodiment, the discharge passages 55 extend axially through the end wall 54 with their axis coinciding substantially to the juncture of the downstream face of the end wall 54 and the side wall 59 such that a portion of the discharge passage communicates with and extends through the downstream face of the end wall 54 and a portion communicates with and extends through the side wall 59. The discharge passages 55 terminate with radially inwardly angled, rounded sides 60 that extend beyond the end wall and through the side wall 64 for directing a portion of the flow stream in a radially inward direction, as depicted in FIG. 4.

In operation, as pre-atomized liquid exits the pre-atomizing member 20 the flow stream will impact the upstream face of the end wall 54, will be turned in a right angle direction, and will ultimately again be turned in a right angle direction to exit through the discharge passages 55, with such action causing further breakdown and atomization of the liquid as an incident to passage through the spray tip. Hence, direct flow of liquid particles through the spray tip 12 is substantially precluded. As the further pre-atomized liquid proceeds through the discharge passages 55, a portion thereof is directed axially through each discharge passage 55, while a portion thereof is directed radially inwardly by the rounded sides 60 of the discharge apertures, thereby preventing excessive outward flaring of the discharging liquid particles and causing the spray to have a well-defined pattern, notwithstanding the discharge of relatively fine particles resulting from high pressurized air pre-atomization. The angle of the discharging spray pattern can thereby be more precisely controlled by the design of the taper of the spray tip side wall 59.

It will be appreciated by one skilled in the art that the spray tip 12 further lends itself to relatively economical manufacture. When made of metal, the upstream and downstream chambers 51, 52 can be readily milled, and the discharge passages 55 may be drilled with rounded or flat end drill points, which form the sides 60. Since the upstream chamber 51, the downstream chamber 52, and the discharge passages 55 are co-axial, the machining operations can be carried out efficiently. It will be understood, of course, that the spray tip also could be economically molded of plastic.

Referring now to FIGS. 5–8, there is shown an alternative embodiment of spray nozzle assembly 10*a* in accordance with the invention, wherein items similar to those described above have been given similar reference numerals with the distinguishing suffix "a" added. The spray nozzle assembly 10*a* has a spray tip 12*a* formed with a cylindrical upstream chamber 51*a* and a downstream chamber 51*a* which in this case is defined by a milled cross slot extending completely across the end of the spray tip. The illustrated downstream chamber 52*a* has a side wall defined by opposed walls 59*a* that are parallel to the spray tip axis 57*a*. The spray tip 12*a* again has a plurality of discharge passages 55*a*, in this case two in number, which have axes substantially intersecting the junctures between a downstream face of the end wall 54*a* and a respective side wall 59*a* such that a portion of each discharge passage communicates through the downstream face of the end wall 54*a* and a portion communicates through a side wall 59*a*.

Pre-atomized liquid introduced into the upstream chamber 51*a* of the spray tip from the atomizing member 20*a* again impacts the end wall 54*a* and is ultimately directed through the discharge passages 55*a*, with a portion of the particles passing axially through the discharge passages and a portion being directed inwardly by means of inwardly turned sides 60*a* of the discharge passages 55*a* for preventing excessive outward flaring of the discharging liquid particles and for producing a relatively narrow flat spray pattern. The spray angle of the discharging flat spray pattern can be controlled by varying the width "w" of the cross slot which defines the downstream chamber 52*a*, as well as by varying the orientation of the sides walls 59*a*, which may be parallel to the axis 57*a* of the spray tip, or angled with respect thereto.

From the foregoing, it can be seen that the spray nozzle assembly of the present invention is adapted for generating well-defined round and flat liquid spray patterns. The spray tip, furthermore, has a unique design which not only controls the discharging fine particle spray, but also augments fine liquid particle generation. Hence, the spray nozzle assembly is adapted for more efficient atomization, and the simplicity of the spray tip design lends itself to economical manufacture.

What is claimed is:

1. A spray nozzle assembly comprising a nozzle body having a liquid inlet port and a gas inlet port, a pre-atomizing section within which pressurized streams of liquid and air introduced through said liquid inlet port and gas inlet port are forcefully intermixed to pre-atomize the liquid, a spray tip downstream of said pre-atomizing section, said spray tip having an inlet for receiving pre-atomized liquid from said pre-atomizing section, said spray tip having a downstream chamber separated from said inlet by an end wall, said downstream chamber being defined by a substantially flat downstream face and a side wall extending downstream and at an angle to said downstream face, and said end wall having a plurality of discharge passages which communicate between said inlet and said downstream chamber in a manner that directs a plurality of discharging flow streams in part in a downstream direction and in part in an inward radial direction toward each other to provide a discharging spray pattern exiting from said downstream chamber.

2. The spray nozzle assembly of claim 1 in which said spray tip inlet is defined by an upstream chamber communicating with said pre-atomizing section.

3. The spray nozzle assembly of claim 1 in which said pre-atomizing section includes an atomizing member formed with a flow restricting orifice and a downstream expansion chamber, and said atomizing member being formed with a plurality of radial air passages communicating with said gas inlet port for directing pressurized gas streams transversely into said expansion chamber.

4. A spray nozzle assembly comprising a nozzle body having a liquid inlet port and a gas inlet port, a pre-atomizing section within which pressurized streams of liquid and air introduced through said liquid inlet port and gas inlet port are forcefully intermixed to pre-atomize the liquid, a spray tip downstream of said pre-atomizing section, said spray tip having an upstream chamber for receiving pre-atomized liquid from said pre-atomizing section, said spray tip having a downstream chamber separated from said upstream chamber by an end wall, said downstream chamber being defined by a substantially flat downstream face of said end wall and a side wall extending downstream and at an angle to said downstream face, and said end wall having a plurality of discharge passages each communicating through said end wall at a location at about the juncture of said downstream face and side wall for directing a plurality of discharging flow streams into said chamber to produce a resulting spray pattern exiting from said chamber.

5. A spray nozzle assembly comprising a nozzle body having a liquid inlet port and a gas inlet port, a pre-atomizing section within which pressurized streams of liquid and air introduced through said liquid inlet port and gas inlet port are forcefully intermixed to pre-atomize the liquid, a spray tip downstream of said pre-atomizing section, said spray tip having an upstream chamber for receiving pre-atomized liquid from said pre-atomizing section, said spray tip having a downstream chamber separated from said upstream chamber by an end wall, said downstream chamber being defined by a substantially flat downstream face of said end wall and a side wall extending downstream and at an angle to said downstream face and said end wall having a plurality of discharge passages located adjacent an outer periphery of an upstream face thereof and communicating with said downstream chamber in a manner that directs the discharging flow streams from said discharge passages at least in part in a direction toward each other to provide a desired spray pattern exiting from said downstream chamber.

6. A spray nozzle assembly comprising a nozzle body having a liquid inlet port and a gas inlet port, a pre-atomizing section within which pressurized streams of liquid and air introduced through said liquid inlet port and gas inlet port are forcefully intermixed to pre-atomize the liquid, a spray tip downstream of said pre-atomizing section, said spray tip having an inlet defined by an upstream chamber communicating with said pre-atomizing section for receiving pre-atomized liquid from said pre-atomizing section, said spray tip having a downstream chamber separated from said inlet by an end wall, said downstream chamber being defined by a downstream face of said end wall and a sidewall, said end wall having an upstream face at an end of said upstream chamber and having a plurality of discharge passages disposed adjacent an outer periphery of said upstream face, said passages terminating in part through said downstream face end and in part through said side wall and communicating between said inlet and said downstream chamber in a manner that directs a plurality of discharging flow streams in part in a downstream direction and in part in an inward radial direction toward each other.

7. The spray nozzle assembly of claim 6 in which said discharge passages have axes intersecting a juncture between said downstream face and said side wall.

8. The spray nozzle assembly of claim 7 in which said spray tip discharge passages have axes parallel to the axis of said spray tip.

9. The spray nozzle assembly of claim 7 in which said spray tip has four circumferentially spaced discharge passages.

10. The spray nozzle assembly of claim 6 in which said side wall has an outwardly flared frusto conical shape.

11. A spray nozzle assembly comprising a nozzle body having a liquid inlet port and a gas inlet port, a pre-atomizing section within which pressurized streams of liquid and air introduced through said liquid inlet port and gas inlet port are forcefully intermixed to pre-atomize the liquid, a spray tip downstream of said pre-atomizing section, said spray tip having an inlet for receiving pre-atomized liquid from said pre-atomizing section, said spray tip having a downstream chamber defined by a cross slot extending completely across an end of said spray tip, said downstream chamber separated from said inlet by an end wall, and said end wall having a plurality of discharge passages which communicate between said inlet and said downstream chamber in a manner that directs a plurality of discharging flow streams in part in a downstream direction and in part in an inward radial direction toward each other.

12. The spray nozzle assembly of claim 11 in which said cross slot defines side walls parallel to an axis of said spray tip.

13. The spray nozzle assembly of claim 12 in which said spray tip has two discharge passages each communicating with a juncture between the downstream face of said end wall and a side wall defined by said cross slot.

14. A spray nozzle assembly comprising a nozzle body having a liquid inlet port and a gas inlet port, a pre-atomizing section within which pressurized streams of liquid and air introduced through said liquid inlet port and gas inlet port are forcefully intermixed to pre-atomize the liquid, a spray tip downstream of said pre-atomizing section, said spray tip having an inlet for receiving pre-atomized liquid from said pre-atomizing section, said spray tip having a downstream chamber separated from said inlet by an end wall, and said end wall having a plurality of discharge passages which terminate at a downstream end with a radially inwardly angled wall communicating with a side wall of said downstream chamber and which communicate between said inlet and said downstream chamber in a manner that directs a plurality of discharging flow streams in part in a downstream direction and in part in an inward radial direction toward each other.

15. The spray nozzle assembly of claim 14 in which said discharge passages each terminate at a downstream end with a rounded side wall communicating with the side wall of said downstream chamber.

16. A spray nozzle assembly comprising a nozzle body having a liquid inlet port and a gas inlet port, a pre-atomizing section within which pressurized streams of liquid and air introduced through said liquid inlet port and gas inlet port are forcefully intermixed to pre-atomize the liquid, a spray tip downstream of said pre-atomizing section, said spray tip having an upstream chamber for receiving pre-atomized liquid from said pre-atomizing section, said spray tip having a downstream chamber separated from said upstream chamber by an end wall, said downstream chamber being defined by a downstream face of said end wall and a side wall, and said end wall having a plurality of discharge passages each communicating through said end wall at a location at about the juncture of said downstream face and side wall for directing a plurality of discharging flow streams into said chamber, said discharge passages extending at least in part through said side wall for directing at least a part of said discharging flow streams in a direction toward each other.

17. The spray nozzle assembly of claim 16 in which said end wall has an upstream face at an end of said upstream chamber, and said discharge passages are disposed adjacent an outer periphery of said upstream face.

18. A spray nozzle assembly comprising a nozzle body having a liquid inlet port and a gas inlet port, a pre-atomizing section within which pressurized streams of liquid and air introduced through said liquid inlet port and gas inlet port are forcefully intermixed to pre-atomize the liquid, a spray tip downstream of said pre-atomizing section, said spray tip having an upstream chamber for receiving pre-atomized liquid from said pre-atomizing section, said spray tip having a downstream chamber separated from said upstream chamber by an end wall, said downstream chamber being defined by a downstream face of said end wall and a side wall with an outwardly flared frusto conical shape, and said end wall having a plurality of discharge passages each communicating through said end wall at a location at about the juncture of said downstream face and side wall chamber for directing a plurality of discharging flow streams into said chamber.

19. A spray nozzle assembly comprising a nozzle body having a liquid inlet port and a gas inlet port, a pre-atomizing section within which pressurized streams of liquid and air introduced through said liquid inlet port and gas inlet port are forcefully intermixed to pre-atomize the liquid, a spray tip downstream of said pre-atomizing section, said spray tip having an upstream chamber for receiving pre-atomized liquid from said pre-atomizing section, said spray tip having a downstream chamber in the form of a cross slot extending completely across an end of said spray tip and separated from said upstream chamber by an end wall, said downstream chamber being defined by a downstream face of said end wall and a side wall, and said end wall having a plurality of discharge passages each communicating through said end wall at a location at about the juncture of said downstream face and side wall chamber for directing a plurality of discharging flow streams into said chamber.

20. A spray nozzle assembly comprising a nozzle body having a liquid inlet port and a gas inlet port, a pre-atomizing section within which pressurized streams of liquid and air introduced through said liquid inlet port and gas inlet port are forcefully intermixed to pre-atomize the liquid, a spray tip downstream of said pre-atomizing section, said spray tip having an upstream chamber for receiving pre-atomized liquid from said pre-atomizing section, said spray tip having a downstream chamber separated from said upstream chamber by an end wall, said downstream chamber being defined by a downstream face of said end wall and a side wall, and said end wall having a plurality of discharge passages each communicating through said end wall at a location at about the juncture of said downstream face and side wall chamber for directing a plurality of discharging flow streams into said chamber, said discharge passages terminating at a downstream end with an angled wall communicating with the side wall of said downstream chamber.

21. A spray nozzle assembly comprising a nozzle body having a liquid inlet port and a gas inlet port, a pre-atomizing section within which pressurized streams of liquid and air introduced through said liquid inlet port and gas inlet port are forcefully intermixed to pre-atomize the liquid, a spray tip downstream of said pre-atomizing section, said spray tip having an upstream chamber for receiving pre-atomized liquid from said pre-atomizing section, said spray tip having a downstream chamber separated from said upstream chamber by an end wall, said downstream chamber being defined by a downstream face of said end wall and a side wall, and said end wall having a plurality of discharge passages located adjacent an outer periphery of an upstream face thereof and communicating with said downstream chamber in a manner that directs the discharging flow streams from said discharge passages at least in part in a direction toward each other, said discharge passages communicating at least in part with said downstream chamber through said side wall.

22. The spray nozzle assembly of claim 21 in which said side wall has a frusto conical shape.

23. The spray nozzle assembly of claim 21 in which said downstream chamber is in the form of a cross slot extending completely across an end of said spray tip.

24. The spray nozzle assembly of claim 21 in which said discharge passages terminate at a downstream end with an angled wall communicating with the side wall of said downstream chamber.

25. A spray nozzle assembly comprising a nozzle body having a liquid inlet port and a gas inlet port, a pre-atomizing section within which pressurized streams of liquid and air introduced through said liquid inlet port and gas inlet port are forcefully intermixed to pre-atomize the liquid, a spray tip downstream of said pre-atomizing section, said spray tip having an inlet defined by an upstream chamber communicating with said pre-atomizing section for receiving pre-atomized liquid from said pre-atomizing section, said spray tip having a downstream chamber separated from said inlet by an end wall having an upstream face at an end of said upstream chamber, and said end wall having a plurality of discharge passages disposed adjacent an outer periphery of said upstream face which communicate between said inlet and said downstream chamber in a manner that directs a plurality of discharging flow streams in part in a downstream direction and in part in an inward radial direction toward each other to provide a discharging spray pattern exiting from said downstream chamber.

26. A spray nozzle assembly comprising a nozzle body having a liquid inlet port and a gas inlet port, said inlet ports communicating from opposite ends of said body, a pre-atomizing section within which pressurized streams of liquid and air introduced through said liquid inlet port and gas inlet port are forcefully intermixed to pre-atomize the liquid, said pre-atomizing section including an atomizing member mounted within said body at a location between said liquid and gas ports and formed with a flow restricting orifice and a downstream expansion chamber, said atomizing member being formed with a plurality of radial air passages communicating with said gas inlet port for directing pressurized gas streams transversely into said expansion chamber, a spray tip downstream of said pre-atomizing section, said spray tip having an inlet for receiving pre-atomized liquid from said pre-atomizing section, said spray tip having a downstream chamber separated from said inlet by an end wall, and said end wall having a plurality of discharge passages which communicate between said inlet and said downstream chamber in a manner that directs a plurality of discharging flow streams in part in a downstream direction and in part in an inward radial direction toward each other to provide a discharging spray pattern exiting from said downstream chamber.

* * * * *